US010292217B2

(12) United States Patent
Zhu et al.

(10) Patent No.: US 10,292,217 B2
(45) **Date of Patent: *May 14, 2019**

(54) SYSTEMS AND METHODS FOR DIMMING CONTROL USING SYSTEM CONTROLLERS

(71) Applicant: ON-BRIGHT ELECTRONICS (SHANGHAI) CO., LTD., Shanghai (CN)

(72) Inventors: Liqiang Zhu, Shanghai (CN); Jun Zhou, Shanghai (CN); Lieyi Fang, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/372,324

(22) Filed: Dec. 7, 2016

(65) Prior Publication Data

US 2017/0181235 A1 Jun. 22, 2017

Related U.S. Application Data

(63) Continuation of application No. 14/819,200, filed on Aug. 5, 2015, now Pat. No. 9,554,432, which is a (Continued)

(30) Foreign Application Priority Data

May 17, 2012 (CN) ..... 2012 1 0166672

(51) Int. Cl.
*H05B 33/08* (2006.01)

(52) U.S. Cl.
CPC ..... *H05B 33/0815* (2013.01); *H05B 33/0851* (2013.01); *H05B 33/0887* (2013.01); *H05B 33/0845* (2013.01)

(58) Field of Classification Search
None
See application file for complete search history.

(56) References Cited

U.S. PATENT DOCUMENTS 3,803,452 A 4/1974 Goldschmied
3,899,713 A 8/1975 Barkan et al.
(Continued)

FOREIGN PATENT DOCUMENTS

CN 1448005 A 10/2003
CN 101657057 A 2/2010
(Continued)

OTHER PUBLICATIONS

China Patent Office, Office Action dated Aug. 28, 2015, in Application No. 201410322602.9.
(Continued)

*Primary Examiner* — Dedei K Hammond
(74) *Attorney, Agent, or Firm* — Faegre Baker Daniels LLP

(57) ABSTRACT

System and method for dimming control. The system includes a system controller, a transistor, and a resistor. The system controller includes a first controller terminal and a second controller terminal. The transistor includes a first transistor terminal, a second transistor terminal and a third transistor terminal. The resistor including a first resistor terminal and a second resistor terminal. The first transistor terminal is coupled, directly or indirectly, to the second controller terminal. The first resistor terminal is coupled to the second transistor terminal. The second resistor terminal is coupled to the third transistor terminal. The system controller is configured to receive an input signal at the first controller terminal and to generate an output signal at the second controller terminal. The transistor is configured to
(Continued)

receive the output signal at the first transistor terminal and to change between a first condition and a second condition.

17 Claims, 11 Drawing Sheets

Related U.S. Application Data continuation of application No. 13/527,475, filed on Jun. 19, 2012, now Pat. No. 9,301,349.

(56) References Cited

U.S. PATENT DOCUMENTS 4,253,045 A 2/1981 Weber
5,144,205 A 9/1992 Motto et al.
5,249,298 A 9/1993 Bolan et al.
5,504,398 A 4/1996 Rothenbuhler
5,949,197 A 9/1999 Kastner
6,218,788 B1 4/2001 Chen et al.
6,229,271 B1 5/2001 Liu
6,278,245 B1 8/2001 Li et al.
7,038,399 B2 5/2006 Lys et al.
7,649,327 B2 1/2010 Peng
7,825,715 B1 11/2010 Greenberg
7,880,400 B2 2/2011 Zhou et al.
7,944,153 B2 5/2011 Greenfeld
8,134,302 B2 * 3/2012 Yang ..... H05B 33/0851 315/219
8,278,832 B2 * 10/2012 Hung ..... H05B 33/0815 315/219
8,378,583 B2 2/2013 Hying et al.
8,378,588 B2 2/2013 Kuo et al.
8,378,589 B2 2/2013 Kuo et al.
8,415,901 B2 4/2013 Recker et al.
8,432,438 B2 4/2013 Ryan et al.
8,497,637 B2 7/2013 Liu
8,569,956 B2 10/2013 Shteynberg et al.
8,644,041 B2 2/2014 Pansier
8,698,419 B2 4/2014 Yan et al.
8,716,882 B2 5/2014 Pettler et al.
8,890,440 B2 11/2014 Yan et al.
8,941,324 B2 1/2015 Zhou et al.
9,030,122 B2 5/2015 Yan et al.
9,084,316 B2 7/2015 Melanson et al.
9,148,050 B2 9/2015 Chiang
9,220,133 B2 12/2015 Salvestrini et al.
9,220,136 B2 12/2015 Zhang
9,247,623 B2 1/2016 Recker et al.
9,247,625 B2 1/2016 Recker et al.
9,301,349 B2 3/2016 Zhu et al.
9,332,609 B1 5/2016 Rhodes et al.
9,402,293 B2 7/2016 Vaughan et al.
9,408,269 B2 8/2016 Zhu et al.
9,414,455 B2 8/2016 Zhou et al.
9,480,118 B2 10/2016 Liao et al.
9,554,432 B2 * 1/2017 Zhu ..... H05B 33/0815
9,585,222 B2 2/2017 Zhu et al.
9,655,188 B1 5/2017 Lewis et al.
9,723,676 B2 8/2017 Ganick et al.
9,750,107 B2 8/2017 Zhu et al.
9,883,561 B1 1/2018 Liang et al.
9,883,562 B2 1/2018 Zhu et al.
9,961,734 B2 6/2018 Zhu et al.
10,054,271 B2 8/2018 Xiong et al.
2006/0022648 A1 2/2006 Ben-Yaakov et al.
2007/0182338 A1 8/2007 Shteynberg et al.
2007/0182699 A1 8/2007 Ha et al.
2007/0267978 A1 11/2007 Shteynberg et al.
2008/0224629 A1 9/2008 Melanson
2008/0278092 A1 11/2008 Lys et al.
2009/0021469 A1 1/2009 Yeo et al.
2009/0251059 A1 10/2009 Veltman
2010/0141153 A1 6/2010 Recker et al.
2010/0156319 A1 6/2010 Melanson
2010/0164406 A1 7/2010 Kost et al.
2010/0176733 A1 7/2010 King
2010/0207536 A1 8/2010 Burdalski
2010/0213859 A1 8/2010 Shteynberg
2010/0231136 A1 9/2010 Reisenauer et al.
2011/0037399 A1 2/2011 Hung et al.
2011/0080110 A1 4/2011 Nuhfer et al.
2011/0080111 A1 4/2011 Nuhfer et al.
2011/0101867 A1 5/2011 Wang et al.
2011/0121744 A1 5/2011 Salvestrini
2011/0121754 A1 5/2011 Shteynberg
2011/0133662 A1 6/2011 Yan et al.
2011/0227490 A1 9/2011 Huynh
2011/0260619 A1 10/2011 Sadwick
2011/0285301 A1 11/2011 Kuang et al.
2011/0291583 A1 12/2011 Shen
2011/0309759 A1 12/2011 Shteynberg
2012/0001548 A1 1/2012 Recker et al.
2012/0032604 A1 2/2012 Hontele
2012/0069616 A1 3/2012 Kitamura et al.
2012/0080944 A1 4/2012 Recker et al.
2012/0081009 A1 4/2012 Shteynberg et al.
2012/0146526 A1 6/2012 Lam et al.
2012/0181944 A1 7/2012 Jacobs et al.
2012/0181946 A1 7/2012 Melanson
2012/0187857 A1 7/2012 Ulmann et al.
2012/0242237 A1 9/2012 Chen et al.
2012/0262093 A1 10/2012 Recker et al.
2012/0268031 A1 10/2012 Zhou et al.
2012/0299500 A1 11/2012 Sadwick
2012/0299501 A1 11/2012 Kost et al.
2012/0319604 A1 12/2012 Walters
2012/0326616 A1 12/2012 Sumitani et al.
2013/0009561 A1 1/2013 Briggs
2013/0020965 A1 1/2013 Kang et al.
2013/0026942 A1 1/2013 Ryan et al.
2013/0026945 A1 1/2013 Ganick et al.
2013/0027528 A1 1/2013 Staats et al.
2013/0043726 A1 2/2013 Krishnamoorthy et al.
2013/0063047 A1 3/2013 Veskovic
2013/0154487 A1 6/2013 Kuang et al.
2013/0162158 A1 6/2013 Pollischanshy
2013/0175931 A1 7/2013 Sadwick
2013/0181630 A1 7/2013 Taipale et al.
2013/0193879 A1 8/2013 Sadwick
2013/0194848 A1 8/2013 Bernardinis et al.
2013/0215655 A1 8/2013 Yang et al.
2013/0223107 A1 8/2013 Zhang et al.
2013/0241427 A1 9/2013 Kesterson et al.
2013/0241428 A1 9/2013 Takeda
2013/0241441 A1 9/2013 Myers et al.
2013/0242622 A1 9/2013 Peng
2013/0307431 A1 11/2013 Zhu et al.
2013/0307434 A1 11/2013 Zhang
2014/0009082 A1 1/2014 King et al.
2014/0029315 A1 1/2014 Zhang et al.
2014/0063857 A1 3/2014 Peng
2014/0078790 A1 3/2014 Lin et al.
2014/0103829 A1 4/2014 Kang
2014/0132172 A1 5/2014 Zhu et al.
2014/0160809 A1 6/2014 Lin et al.
2014/0176016 A1 6/2014 Li et al.
2014/0197760 A1 7/2014 Radermacher
2014/0265898 A1 9/2014 Del Carmen, Jr. et al.
2014/0265935 A1 9/2014 Sadwick
2014/0268935 A1 9/2014 Chiang
2014/0346973 A1 11/2014 Zhu et al.
2014/0354170 A1 12/2014 Gredler
2015/0035450 A1 2/2015 Werner
2015/0077009 A1 3/2015 Kunimatsu
2015/0091470 A1 4/2015 Zhou et al.
2015/0312982 A1 10/2015 Melanson
2015/0312988 A1 10/2015 Liao et al.
2015/0333764 A1 11/2015 Pastore et al.
2015/0357910 A1 12/2015 Murakami et al.
2015/0359054 A1 12/2015 Lin et al.
2015/0366010 A1 12/2015 Mao et al.
2016/0014861 A1 1/2016 Zhu et al.
2016/0014865 A1 1/2016 Zhu et al.

(56) References Cited

U.S. PATENT DOCUMENTS

| | | | |
|---|---|---|---|
| 2016/0037604 | A1 | 2/2016 | Zhu et al. |
| 2016/0119998 | A1 | 4/2016 | Linnartz et al. |
| 2016/0286617 | A1 | 9/2016 | Takahashi et al. |
| 2016/0338163 | A1 | 11/2016 | Zhu et al. |
| 2017/0027029 | A1 | 1/2017 | Hu et al. |
| 2017/0064787 | A1 | 3/2017 | Liao et al. |
| 2017/0196063 | A1 | 7/2017 | Zhu et al. |
| 2017/0251532 | A1 | 8/2017 | Wang et al. |
| 2017/0311409 | A1 | 10/2017 | Zhu et al. |
| 2017/0354008 | A1 | 12/2017 | Eum et al. |
| 2018/0103520 | A1 | 4/2018 | Zhu et al. |
| 2018/0110104 | A1 | 4/2018 | Liang et al. |
| 2018/0288845 | A1 | 10/2018 | Zhu et al. |

FOREIGN PATENT DOCUMENTS

| | | | |
|---|---|---|---|
| CN | 101868090 | | 10/2010 |
| CN | 101896022 | A | 11/2010 |
| CN | 101917804 | A | 12/2010 |
| CN | 101998734 | A | 3/2011 |
| CN | 102014540 | | 4/2011 |
| CN | 102014551 | A | 4/2011 |
| CN | 102056378 | A | 5/2011 |
| CN | 102209412 | A | 10/2011 |
| CN | 102300375 | A | 12/2011 |
| CN | 102347607 | | 2/2012 |
| CN | 102387634 | A | 3/2012 |
| CN | 103004290 | | 3/2012 |
| CN | 102474953 | | 5/2012 |
| CN | 102497706 | | 6/2012 |
| CN | 202353859 | U | 7/2012 |
| CN | 102695330 | A | 9/2012 |
| CN | 102791056 | A | 11/2012 |
| CN | 102843836 | A | 12/2012 |
| CN | 202632722 | U | 12/2012 |
| CN | 102870497 | | 1/2013 |
| CN | 102946674 | A | 2/2013 |
| CN | 103024994 | A | 4/2013 |
| CN | 103260302 | A | 8/2013 |
| CN | 103313472 | | 9/2013 |
| CN | 103369802 | A | 10/2013 |
| CN | 103379712 | A | 10/2013 |
| CN | 103547014 | | 1/2014 |
| CN | 103716934 | | 4/2014 |
| CN | 103858524 | | 6/2014 |
| CN | 203675408 | U | 6/2014 |
| CN | 103945614 | A | 7/2014 |
| CN | 103096606 | B | 12/2014 |
| CN | 103781229 | B | 9/2015 |
| CN | 105265019 | | 1/2016 |
| CN | 105423140 | A | 3/2016 |
| CN | 105591553 | A | 5/2016 |
| CN | 105873269 | | 8/2016 |
| CN | 205812458 | U | 12/2016 |
| CN | 106358337 | A | 1/2017 |
| CN | 106793246 | A | 5/2017 |
| CN | 107046751 | A | 8/2017 |
| EP | 2403318 | A1 | 1/2012 |
| JP | 2008-010152 | A | 1/2008 |
| JP | 2011-249328 | A | 12/2011 |
| TW | 201215228 | A1 | 9/2010 |
| TW | 201125441 | A | 7/2011 |
| TW | 201132241 | | 9/2011 |
| TW | 201143530 | A | 12/2011 |
| TW | 201146087 | A1 | 12/2011 |
| TW | 201204168 | A1 | 1/2012 |
| TW | 201208463 | A1 | 2/2012 |
| TW | 201208481 | A1 | 2/2012 |
| TW | 201208486 | | 2/2012 |
| TW | 201233021 | A | 8/2012 |
| TW | I 387396 | | 2/2013 |
| TW | 201315118 | A | 4/2013 |
| TW | 201322825 | A | 6/2013 |
| TW | 201342987 | | 10/2013 |
| TW | I-422130 | | 1/2014 |
| TW | I 423732 | | 1/2014 |
| TW | 201412189 | A | 3/2014 |
| TW | 201414146 | A | 4/2014 |
| TW | M477115 | | 4/2014 |
| TW | 201417626 | A | 5/2014 |
| TW | 201417631 | | 5/2014 |
| TW | 201422045 | | 6/2014 |
| TW | 201424454 | A | 6/2014 |
| TW | I 448198 | | 8/2014 |
| TW | 201503756 | A | 1/2015 |
| TW | I 496502 | B | 8/2015 |
| TW | 201630468 | A | 8/2016 |
| TW | 201639415 | A | 11/2016 |

OTHER PUBLICATIONS

China Patent Office, Office Action dated Aug. 8, 2015, in Application No. 201410172086.6.

China Patent Office, Office Action dated Mar. 2, 2016, in Application No. 201410172086.6.

China Patent Office, Office Action dated Dec. 14, 2015, in Application No. 201210166672.0.

China Patent Office, Office Action dated Sep. 2, 2016, in Application No. 201510103579.9.

China Patent Office, Office Action dated Jul. 7, 2014, in Application No. 201210468505.1.

China Patent Office, Office Action dated Jun. 3, 2014, in Application No. 201110103130.4.

China Patent Office, Office Action dated Jun. 30, 2015, in Application No. 201410171893.6.

China Patent Office, Office Action dated Nov. 15, 2014, in Application No. 201210166672.0.

China Patent Office, Office Action dated Oct. 19, 2015, in Application No. 201410322612.2.

China Patent Office, Office Action dated Mar. 22, 2016, in Application No. 201410322612.2.

Taiwan Intellectual Property Office, Office Action dated Jan. 7, 2014, in Application No. 100119272.

Taiwan Intellectual Property Office, Office Action dated Jun. 9, 2014, in Application No. 101124982.

Taiwan Intellectual Property Office, Office Action dated Nov. 13, 2015, in Application No. 103141628.

Taiwan Intellectual Property Office, Office Action dated Sep. 17, 2015, in Application No. 103127108.

Taiwan Intellectual Property Office, Office Action dated Sep. 17, 2015, in Application No. 103127620.

Taiwan Intellectual Property Office, Office Action dated Sep. 25, 2014, in Application No. 101148716.

Taiwan Intellectual Property Office, Office Action dated Apr. 18, 2016, in Application No. 103140989.

United States Patent and Trademark Office, Office Action dated Jan. 13, 2016, in U.S. Appl. No. 14/451,656.

United States Patent and Trademark Office, Notice of Allowance dated Oct. 20, 2016, in U.S. Appl. No. 14/451,656.

United States Patent and Trademark Office, Office Action dated Dec. 17, 2015, in U.S. Appl. No. 14/459,167.

United States Patent and Trademark Office, Office Action dated Sep. 6, 2016, in U.S. Appl. No. 14/459,167.

Taiwan Intellectual Property Office, Office Action dated Aug. 23, 2017, in Application No. 106103535.

United States Patent and Trademark Office, Office Action dated Aug. 29, 2017, in U.S. Appl. No. 15/158,237.

United States Patent and Trademark Office, Notice of Allowance dated Nov. 1, 2017, in U.S. Appl. No. 15/364,100.

United States Patent and Trademark Office, Office Action dated Sep. 12, 2017, in U.S. Appl. No. 15/263,080.

United States Patent and Trademark Office, Notice of Allowance dated Oct. 10, 2017, in U.S. Appl. No. 15/403,520.

United States Patent and Trademark Office, Office Action dated Oct. 3, 2017, in U.S. Appl. No. 15/649,586.

United States Patent and Trademark Office, Office Action dated Oct. 3, 2017, in U.S. Appl. No. 15/649,566.

(56) References Cited

OTHER PUBLICATIONS

United States Patent and Trademark Office, Office Action dated Jun. 27, 2017, in U.S. Appl. No. 14/459,167.
United States Patent and Trademark Office, Notice of Allowance dated Apr. 21, 2017, in U.S. Appl. No. 15/364,100.
United States Patent and Trademark Office, Notice of Allowance dated Jul. 27, 2017, in U.S. Appl. No. 15/364,100.
United States Patent and Trademark Office, Notice of Allowance dated Apr. 21, 2017, in U.S. Appl. No. 14/532,811.
United States Patent and Trademark Office, Office Action dated Apr. 20, 2017, in U.S. Appl. No. 15/263,080.
United States Patent and Trademark Office, Notice of Allowance dated Jul. 13, 2017, in U.S. Appl. No. 15/403,520.
United States Patent and Trademark Office, Notice of Allowance dated Dec. 26, 2017, in U.S. Appl. No. 14/459,167.
United States Patent and Trademark Office, Notice of Allowance dated Mar. 23, 2018, in U.S. Appl. No. 15/158,237.
United States Patent and Trademark Office, Notice of Allowance dated Jan. 30, 2018, in U.S. Appl. No. 15/263,080.
United States Patent and Trademark Office, Notice of Allowance dated Jun. 4, 2018, in U.S. Appl. No. 15/263,080.
United States Patent and Trademark Office, Office Action dated Feb. 16, 2018, in U.S. Appl. No. 15/836,478.
United States Patent and Trademark Office, Office Action dated Jul. 30, 2018, in U.S. Appl. No. 15/836,478.
United States Patent and Trademark Office, Notice of Allowance dated May 23, 2018, in U.S. Appl. No. 15/649,586.
United States Patent and Trademark Office, Office Action dated May 11, 2018, in U.S. Appl. No. 15/649,566.
United States Patent and Trademark Office, Office Action dated Mar. 6, 2018, in U.S. Appl. No. 15/836,461.
Taiwan Intellectual Property Office, Office Action dated Feb. 27, 2018, in Application No. 106136242.
Taiwan Intellectual Property Office, Office Action dated Feb. 6, 2018, in Application No. 106130686.
United States Patent and Trademark Office, Notice of Allowance dated Oct. 19, 2018, in U.S. Appl. No. 15/158,237.
United States Patent and Trademark Office, Notice of Allowance dated Sep. 24, 2018, in U.S. Appl. No. 15/849,452.
United States Patent and Trademark Office, Notice of Allowance dated Oct. 24, 2018, in U.S. Appl. No. 15/649,586.
United States Patent and Trademark Office, Office Action dated Oct. 3, 2018, in U.S. Appl. No. 15/934,460.
United States Patent and Trademark Office, Notice of Allowance dated Oct. 3, 2018, in U.S. Appl. No. 15/263,080.
United States Patent and Trademark Office, Notice of Allowance dated Sep. 24, 2018, in U.S. Appl. No. 15/836,478.
China Patent Office, Office Action dated Nov. 29, 2018, in Application No. 201710828263.5.
China Patent Office, Office Action dated Dec. 3, 2018, in Application No. 201710557179.4.
Taiwan Intellectual Property Office, Office Action dated Jan. 14, 2019, in Application No. 107107508.
United States Patent and Trademark Office, Notice of Allowance dated Jan. 25, 2019, in U.S. Appl. No. 15/849,452.
United States Patent and Trademark Office, Notice of Allowance dated Dec. 27, 2018, in U.S. Appl. No. 15/649,566.
United States Patent and Trademark Office, Office Action dated Jan. 11, 2019, in U.S. Appl. No. 16/009,727.
United States Patent and Trademark Office, Notice of Allowance dated Nov. 30, 2018, in U.S. Appl. No. 15/263,080.
United States Patent and Trademark Office, Notice of Allowance dated Dec. 3, 2018, in U.S. Appl. No. 15/836,478.

* cited by examiner

SYSTEMS AND METHODS FOR DIMMING CONTROL USING SYSTEM CONTROLLERS

1. CROSS-REFERENCES TO RELATED APPLICATIONS

This application is a continuation of U.S. patent application Ser. No. 14/819,200, filed Aug. 5, 2015, which is a continuation of U.S. patent application Ser. No. 13/527,475, filed Jun. 19, 2012, which claims priority to Chinese Patent Application No. 201210166672.0, filed May 17, 2012, all of these applications being commonly assigned and incorporated by reference herein for all purposes.

Additionally, this application is related to U.S. patent application Ser. No. 13/105,780, filed May 11, 2011, which is incorporated by reference herein for all purposes.

2. BACKGROUND OF THE INVENTION

The present invention is directed to integrated circuits. More particularly, the invention provides systems and methods for dimming control with a system controller. Merely by way of example, the invention has been applied to light-emitting-diode (LED) driving systems. But it would be recognized that the invention has a much broader range of applicability.

Light emitting diodes (LEDs) have been widely used in various lighting applications because LEDs have significant advantages, such as high efficiency and long lifetime, over other lighting sources (e.g., incandescent lamps). LED lighting systems often use a conventional light dimmer that includes a Triode for Alternating Current (TRIAC) to adjust the brightness of LEDs. Such a conventional light dimmer is usually designed to drive pure resistive loads (e.g., incandescent lamps), and yet may not function properly when connected to capacitive loads, such as LEDs and/or associated circuits.

When the conventional light dimmer starts conduction, internal inductance of the light dimmer and the capacitive loads may cause low frequency oscillation. Hence, the Alternate Current (AC) waveforms of the conventional light dimmer often becomes unstable and/or distorted, resulting in flickering, undesirable audible noise, and/or even damages to other system components. FIG. 1 shows simplified signal waveforms of a conventional light dimmer that is connected to capacitive loads. The waveform 104 represents a voltage signal generated from a conventional light dimmer, and the waveform 102 represents a rectified signal generated from the voltage signal.

Some measures can be taken to solve the above problems in using a conventional light dimmer with capacitive loads such as LEDs and/or associated circuits. For example, a power resistor (e.g., with a resistance of several hundred Ohms) may be connected in series in an AC loop to dampen initial current surge when the light dimmer starts conduction.

FIG. 2 is a simplified diagram showing a conventional light dimmer system. The light dimmer system 200 includes a light dimmer 204, a rectifier 206, a capacitive load 208, and a power resistor 210. As shown in FIG. 2, the light dimmer 204 receives an AC input 202, and generates a signal 212 which is rectified by the rectifier 206. The rectifier 206 outputs a signal 214 to the capacitor load 208. The power resistor 210 serves to dampen the initial current surge when the light dimmer 204 starts conduction.

FIG. 3 shows simplified conventional signal waveforms of the light dimmer system 200. As shown in FIGS. 2 and 3, the waveform 304 represents the signal 212, and the waveform 302 represents the rectified signal 214. As shown by the waveforms of FIG. 3 compared with the waveforms in FIG. 1, using the resistor 210 in the light dimmer system 200 can reduce low frequency oscillation, and in addition the rectified signal 214 does not show any significant distortion. But, for the light dimmer system 200, a current would flow through the resistor 210 even under normal working conditions, causing excessive heating of resistor and other system components. Such heating often leads to low efficiency and high energy consumption.

Some conventional techniques would short the power resistor through peripheral circuits when the AC input is stabilized after a light dimmer conducts for a predetermined period of time. FIG. 4 is a simplified diagram showing a conventional system for dimming control. The system 400 includes an AC input 404, a light dimmer 402, a damping control circuit 406, a power train 408 and one or more LEDs 488. The damping control circuit 406 includes a power transistor 460, a capacitor 462, and resistors 472, 474, 476, 478 and 480. For example, the resistor 480 is the same as the resistor 210. In another example, the power transistor 460 is a N-type MOS switch.

As shown in FIG. 4, when the light dimmer 402 (e.g., a TRIAC) is turned off, the transistor 460 is turned off by the voltage divider including the resistors 472, 474 and 476. When the TRIAC light dimmer 402 begins conduction, a delay circuit including the resistors 472 and 474 and the capacitor 462 causes the transistor 460 to remain off, while the resistor 480 dampens an initial surge current. After a delay, the transistor 460 is turned on again, and hence the resistor 480 is shorted.

Though the system 400 often has a better efficiency compared with the system 200, the system 400 still suffers from significant deficiencies. For example, the system 400 usually needs many peripheral devices in order to operate properly. In addition, the cost of the system 400 is often very high.

Hence it is highly desirable to improve the techniques of dimming control.

3. BRIEF SUMMARY OF THE INVENTION

The present invention is directed to integrated circuits. More particularly, the invention provides systems and methods for dimming control with a system controller. Merely by way of example, the invention has been applied to light-emitting-diode (LED) driving systems. But it would be recognized that the invention has a much broader range of applicability.

According to one embodiment, a system for dimming control includes a system controller, a transistor, and a first resistor. The system controller includes a first controller terminal and a second controller terminal. The transistor includes a first transistor terminal, a second transistor terminal and a third transistor terminal. The first resistor includes a first resistor terminal and a second resistor terminal. The first transistor terminal is coupled, directly or indirectly, to the second controller terminal. The first resistor terminal is coupled to the second transistor terminal. The second resistor terminal is coupled to the third transistor terminal. The system controller is configured to receive an input signal at the first controller terminal and to generate an output signal at the second controller terminal based on at least information associated with the input signal. The transistor is configured to receive the output signal at the first transistor terminal and to change between a first condition and a second condition based on at least information associated with the output signal. The system controller is further configured to, if the input signal becomes higher than a threshold, change the output signal after a delay in order to change the transistor from the first condition to the second condition.

According to another embodiment, a system controller for dimming control includes a first controller terminal, and a second controller terminal. The system controller is configured to receive an input signal at the first controller terminal and generate a dimming signal based on at least information associated with the input signal, generate a synchronization signal based on at least information associated with the dimming signal, and output a gate drive signal at the second controller terminal based on at least information associated with the synchronization signal. The system controller is further configured to generate a first pulse of the synchronization signal in response to a first rising edge of the dimming signal, the first pulse including a first falling edge and being associated with a first pulse width, and start changing the gate drive signal between a first logic level and a second logic level for a first burst period at the first falling edge of the pulse.

According to yet another embodiment, a system controller for dimming control includes a first controller terminal and a second controller terminal. The system controller is configured to receive an input signal at the first controller terminal and generate a dimming signal based on at least information associated with the input signal, the dimming signal being associated with a dimming period, and output a gate drive signal at the second controller terminal based on at least information associated with the dimming signal, the gate drive signal being related to a plurality of switching periods included within the dimming period. The plurality of switching periods include a plurality of on-time periods respectively. The system controller is further configured to increase the plurality of on-time periods in duration over time.

In one embodiment, a method for dimming control using at least a system controller including a first controller terminal and a second controller terminal includes receiving an input signal at the first controller terminal, processing information associated with the input signal, and generating an output signal at the second controller terminal based on at least information associated with the input signal in order to change a transistor between a first condition and a second condition, the transistor including a first transistor terminal, a second transistor terminal and a third transistor terminal, the first transistor terminal being coupled, directly or indirectly, to the second controller terminal. In addition, the method includes, if the input signal becomes higher than a threshold, changing the output signal after a delay in order to change the transistor from the first condition to the second condition, and shorting a resistor by the transistor in the second condition, the resistor including a first resistor terminal and a second resistor terminal, the first resistor terminal being coupled to the second transistor terminal, the second resistor terminal being coupled to the third transistor terminal.

In another embodiment, a method for dimming control using at least a system controller including a first controller terminal and a second controller terminal includes receiving an input signal at the first controller terminal, processing information associated with the input signal, and generating a dimming signal based on at least information associated with the input signal. Further, the method includes processing information associated with the dimming signal, generating a synchronization signal based on at least information associated with the dimming signal, processing information associated with the synchronization signal, and outputting a gate drive signal at the second controller terminal based on at least information associated with the synchronization signal. The process for generating a synchronization signal based on at least information associated with the dimming signal includes generating a first pulse of the synchronization signal in response to a first rising edge of the dimming signal, the first pulse including a first falling edge and being associated with a first pulse width. The process for outputting a gate drive signal at the second controller terminal based on at least information associated with the synchronization signal includes starting changing the gate drive signal between a first logic level and a second logic level for a first burst period at the first falling edge of the pulse.

In yet another embodiment, a method for dimming control using at least a system controller including a first controller terminal and a second controller terminal includes receiving an input signal at the first controller terminal, processing information associated with the input signal, and generating a dimming signal based on at least information associated with the input signal, the dimming signal being associated with a dimming period. In addition, the method includes processing information associated with the dimming signal, and outputting a gate drive signal at the second controller terminal based on at least information associated with the dimming signal, the gate drive signal being related to a plurality of switching periods included within the dimming period. The plurality of switching periods include a plurality of on-time periods respectively. The plurality of on-time periods increase in duration over time.

Many benefits are achieved by way of the present invention over conventional techniques. For example, some embodiments of the present invention implement a system controller and its peripheral circuits to detect changes of an input signal and generate a signal to drive a switch to connect or short a power resistor for active damping control. In another example, certain embodiments of the present invention synchronize a gate drive signal output to a switch with a dimming signal that indicates when a light dimmer is turned on to regulate power delivered to LEDs to keep LED currents approximately constant at a predetermined level. In yet another example, some embodiments of the present invention adopt a soft control scheme to gradually increase the duty cycle of a gate drive signal to a switch so as to increase gradually a current flowing through the switch to reduce instant current strike to the switch when a light dimmer is turned on.

Depending upon embodiment, one or more benefits may be achieved. These benefits and various additional objects, features and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

The present invention is directed to integrated circuits. More particularly, the invention provides systems and methods for dimming control with a system controller. Merely by way of example, the invention has been applied to light-emitting-diode (LED) driving systems. But it would be recognized that the invention has a much broader range of applicability.

Figure 1:
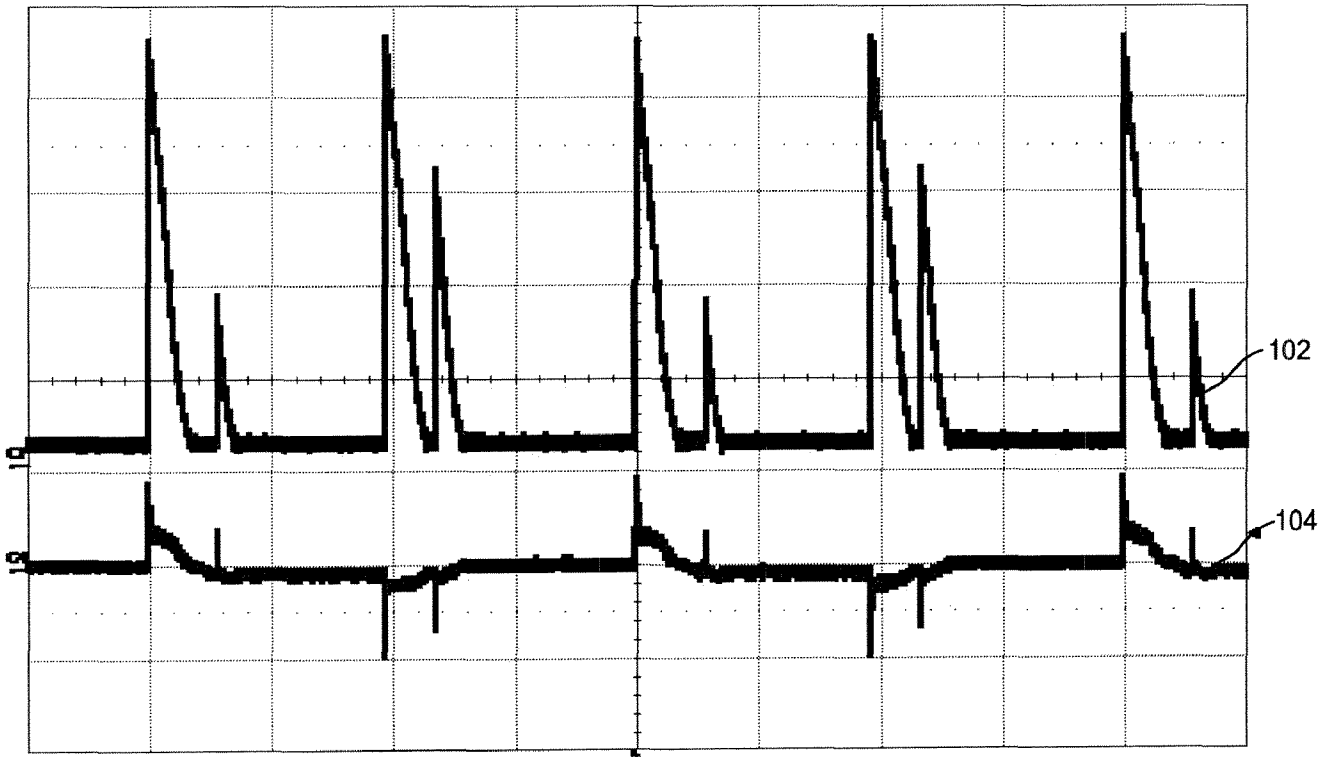
Fig. 1 (Prior Art)
FIG. 1 shows simplified signal waveforms of a conventional light dimmer that is connected to capacitive loads.
Figure 2:
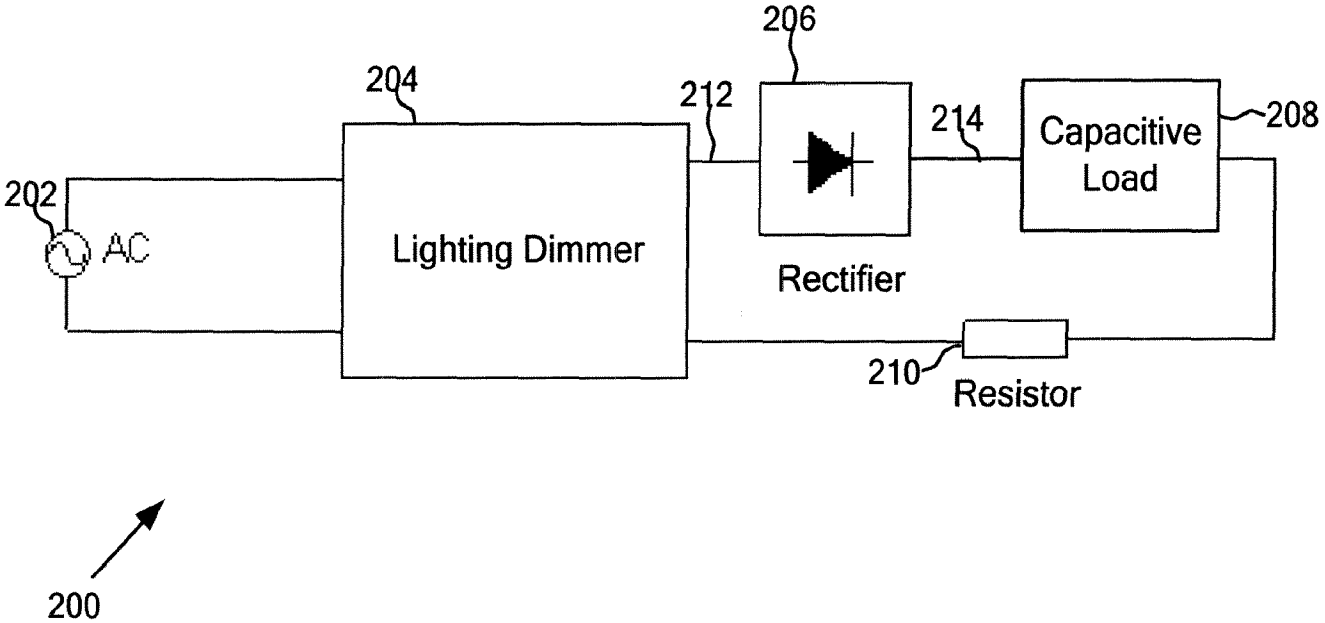
Fig. 2 (Prior Art)
FIG. 2 is a simplified diagram showing a conventional light dimmer system.
Figure 3:
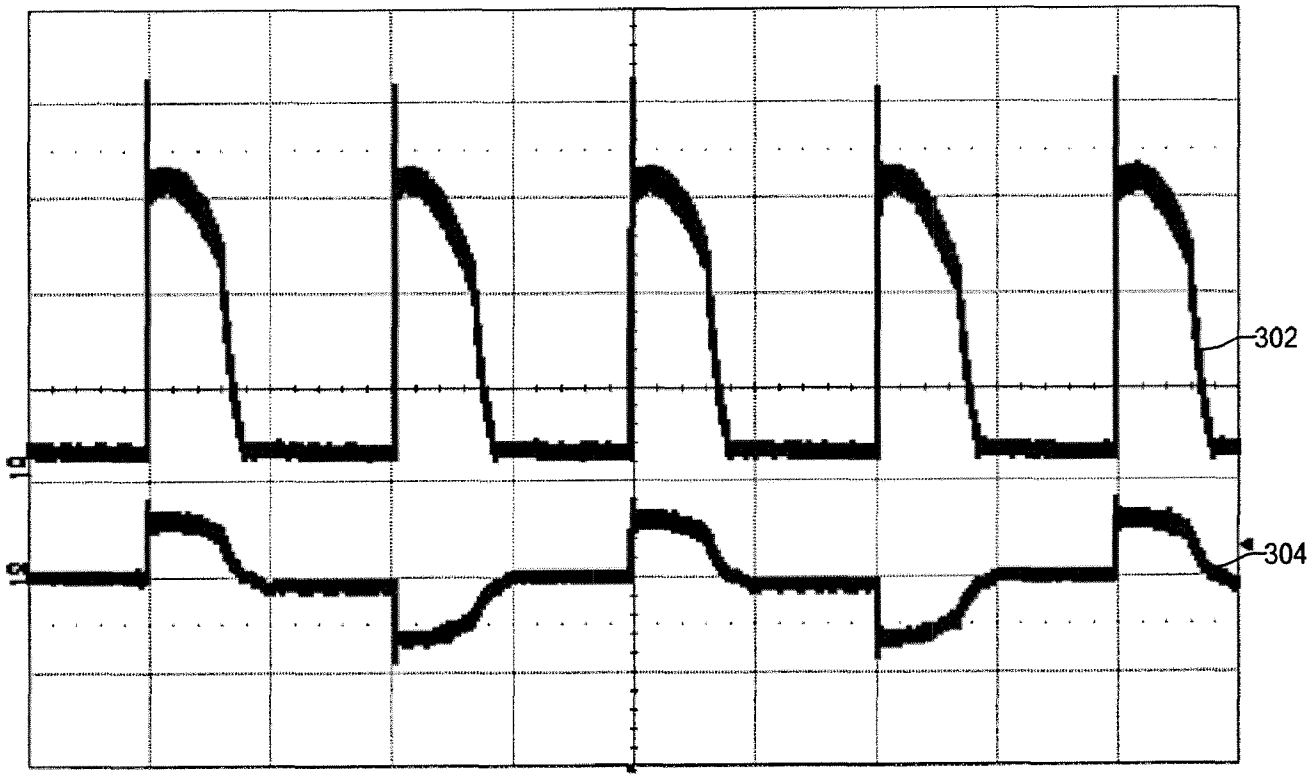
Fig. 3 (Prior Art)
FIG. 3 shows simplified conventional signal waveforms of the light dimmer system shown in FIG. 2.
Figure 4:
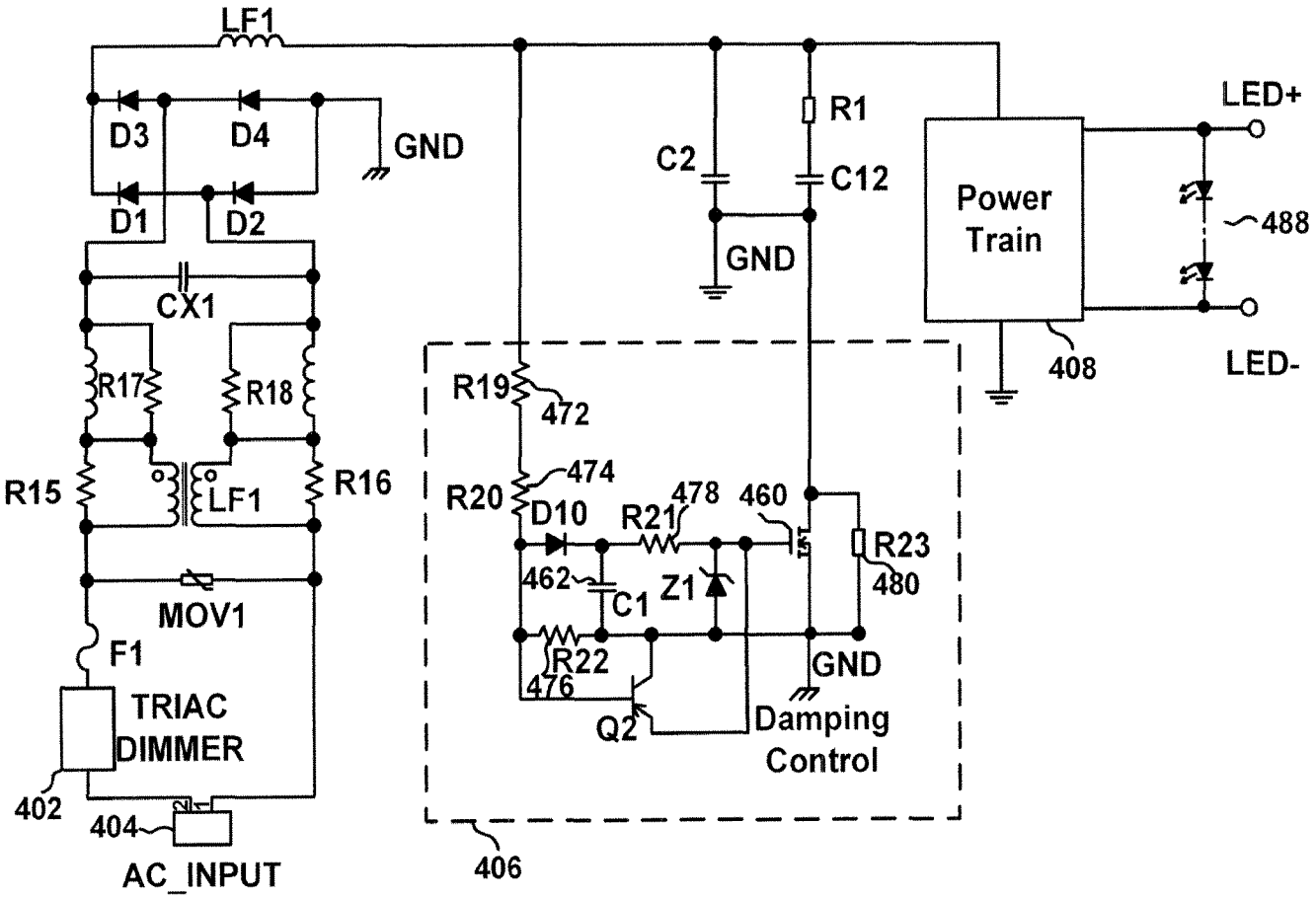
Fig. 4 (Prior Art)
FIG. 4 is a simplified diagram showing a conventional system for dimming control.
Figure 5:
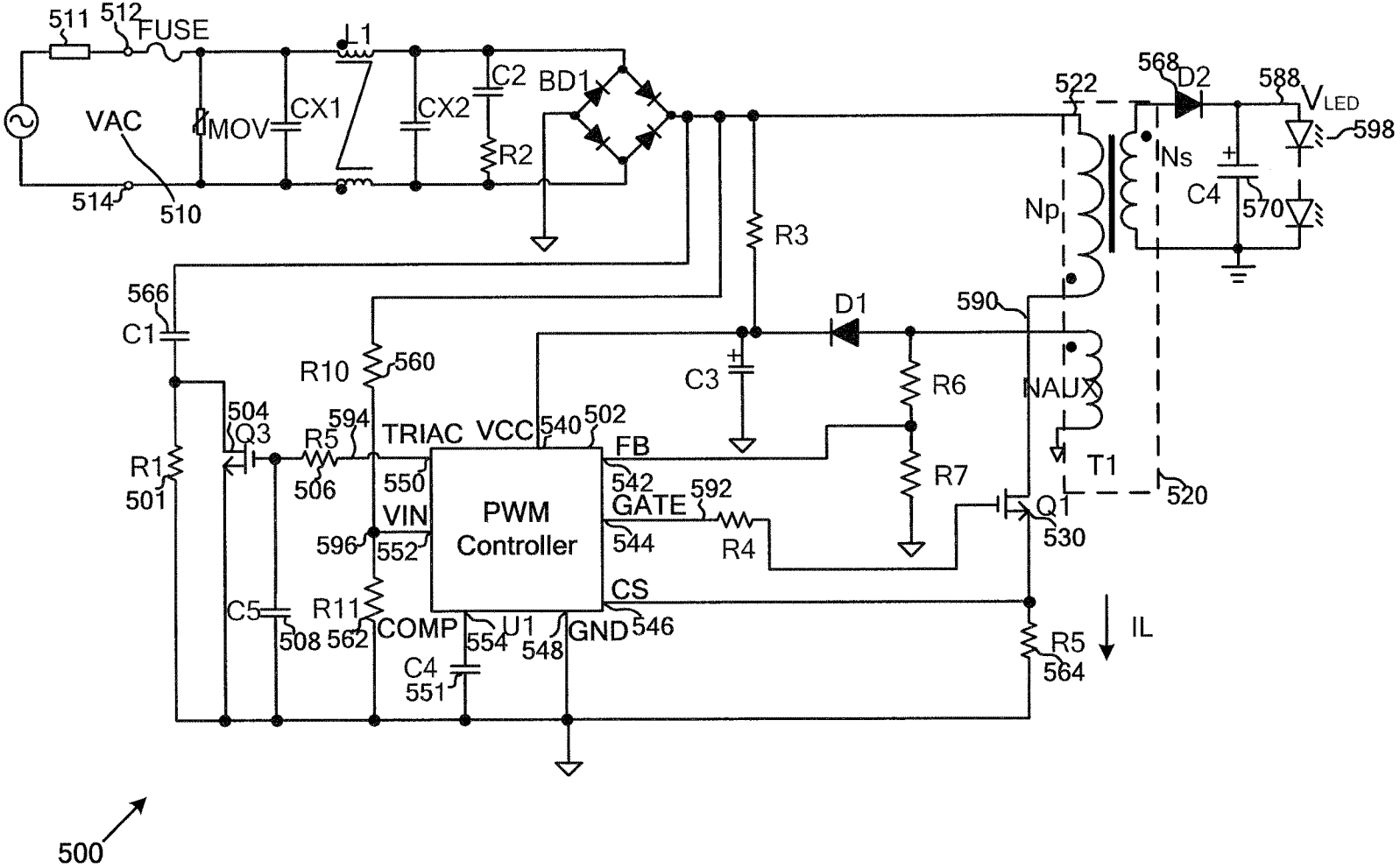
FIG. 5 is a simplified diagram showing a system for dimming control according to an embodiment of the present invention.

FIG. 5 is a simplified diagram showing a system for dimming control according to an embodiment of the present invention. This diagram is merely an example, which should not unduly limit the scope of the claims. One of ordinary skill in the art would recognize many variations, alternatives, and modifications. The system 500 includes a light dimmer 511, input terminals 512 and 514, a system controller 502, resistors 501, 506, 560, 562, 564, capacitors 508, 551, 566 and 570, switches 504 and 530, a transformer 520, a rectifying diode 568, and LEDs 598. For example, the system controller 502 includes terminals 540, 542, 544, 546, 548, 550, 552 and 554. In another example, the switch 504 is a transistor. In yet another example, the switch 530 is a transistor. As shown in FIG. 5, a fly-back structure is implemented as an example.

According to one embodiment, when the light dimmer 511 (e.g., a TRIAC) is turned on, an AC input 510 (e.g., VAC) is provided to the input terminals 512 and 514. For example, at the terminal 552 (e.g., VIN), the system controller 502 receives an input signal 596 related to the AC input 510 from a voltage divider including the resistors 560 and 562. In another example, in response, the system controller 502 generates one or more control signals (e.g., a control signal 594 from the terminal 550) to affect operating status of the switch 504 and the resistor 501. In yet another example, the switch 504 and the resistor 501 are connected in parallel. In yet another example, in response to the control signal 594 from the terminal 550 (e.g., terminal TRIAC), the switch 504 is open (e.g., off), allowing the resistor 501 to dampen initial current surge to one or more capacitive loads. In yet another example, after the light dimmer 511 conducts for a predetermined period of time, the switch 504 is closed (e.g., on) in response to the control signal 594 from the terminal 550 (e.g., terminal TRIAC), thus shorting the resistor 501 in order to improve the system efficiency. In yet another example, the resistor 506 and the capacitor 508 reduce current strikes to the switch 504 when the switch 504 is turned on or off. In yet another example, the system controller 502 outputs a gate-drive signal 592 to the switch 530. In yet another example, in response, the switch 530 is turned on or off to affect a current 590 that flows through a primary winding 522 of the transformer 520 in order to regulate a current 588 that flows through the LEDs 598.

Figure 6:
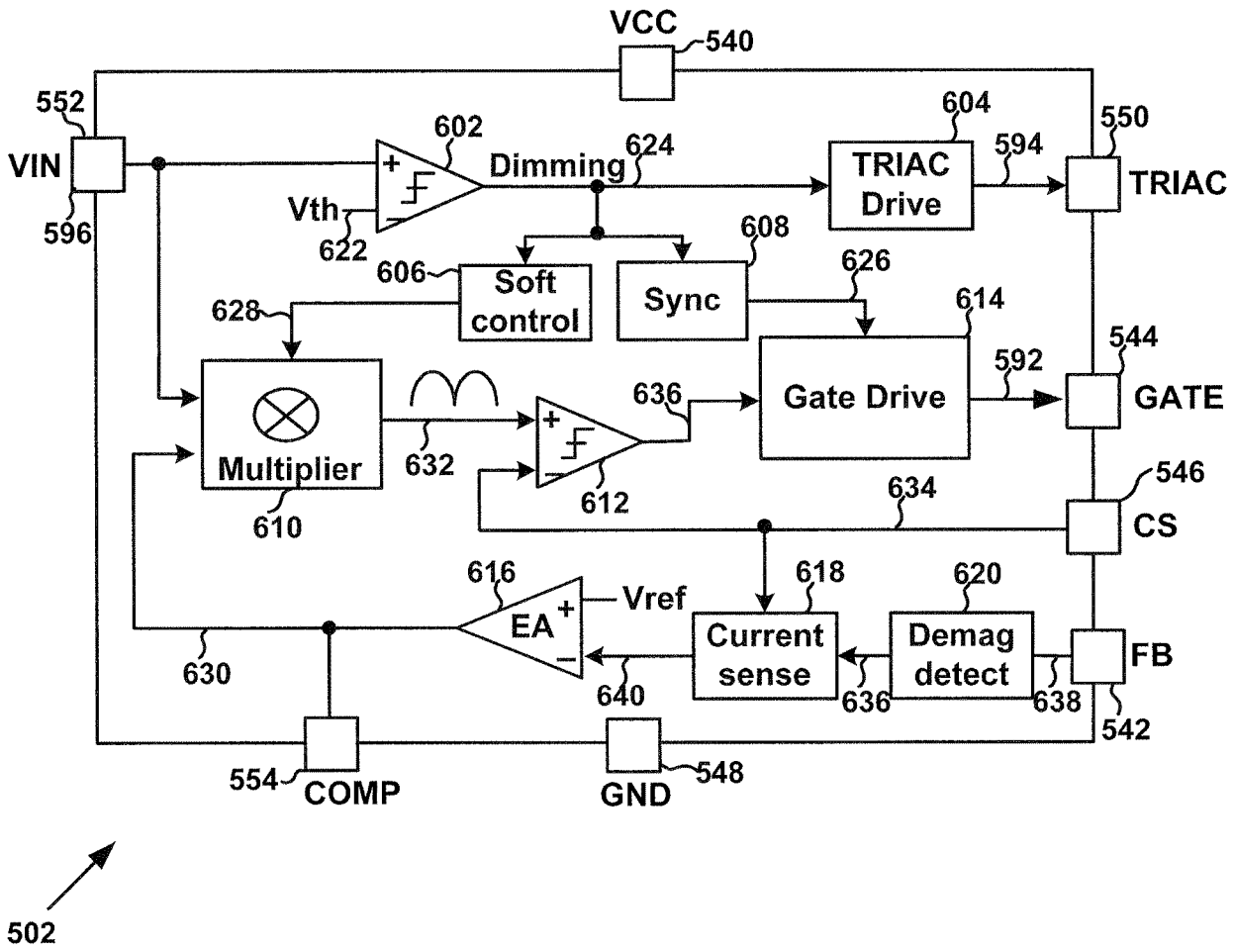
FIG. 6 is a simplified diagram showing the system controller as part of the system shown in FIG. 5 according to an embodiment of the present invention.

FIG. 6 is a simplified diagram showing the system controller 502 as part of the system 500 according to an embodiment of the present invention. This diagram is merely an example, which should not unduly limit the scope of the claims. One of ordinary skill in the art would recognize many variations, alternatives, and modifications. The system controller 502 includes comparators 602 and 612, a signal generator 604, a soft control component 606, a synchronization component 608, a multiplier 610, a gate driver 614, an error amplifier 616, a current sensing component 618, and a demagnetization detector 620.

In one embodiment, the system controller 502 receives the input signal 596 in order to detect the change of the AC input 510. For example, the comparator 602 receives the input signal 596 and a threshold signal 622, and generates a dimming signal 624. In another example, the signal generator 604 receives the dimming signal 624 and generates the control signal 594 to drive the switch 504. In yet another example, the synchronization component 608 also receives the dimming signal 624 and outputs a synchronization signal 626 to the gate driver 614 which generates the gate-drive signal 592 to drive the switch 530. In yet another example, the soft control component 606 receives the dimming signal 624 and generates a signal 628 which is received by the multiplier 610.

In another embodiment, the multiplier 610 also receives the input signal 596 and an amplified signal 630 from the error amplifier 616 and outputs a signal 632. For example, the comparator 612 receives the signal 632 and a current sensing signal 634 that indicates the current 590 flowing through the primary winding 522, and outputs a comparison signal 636 to the gate driver 614 in order to affect the status of the switch 530.

In yet another embodiment, the demagnetization component 620 receives a feedback signal 638 to detect when a demagnetization process associated with the secondary side of the transformer 520 ends, and outputs a demagnetization signal 636 to the current sensing component 618 in order to affect the sampling and/or holding of the current sensing signal 634. For example, the error amplifier 616 receives a signal 640 from the current sensing component 618, and an output terminal of the error amplifier 616 is connected to the capacitor 551 through the terminal 554 (e.g., COMP) in order to keep the system 500 stable.

Figure 7:
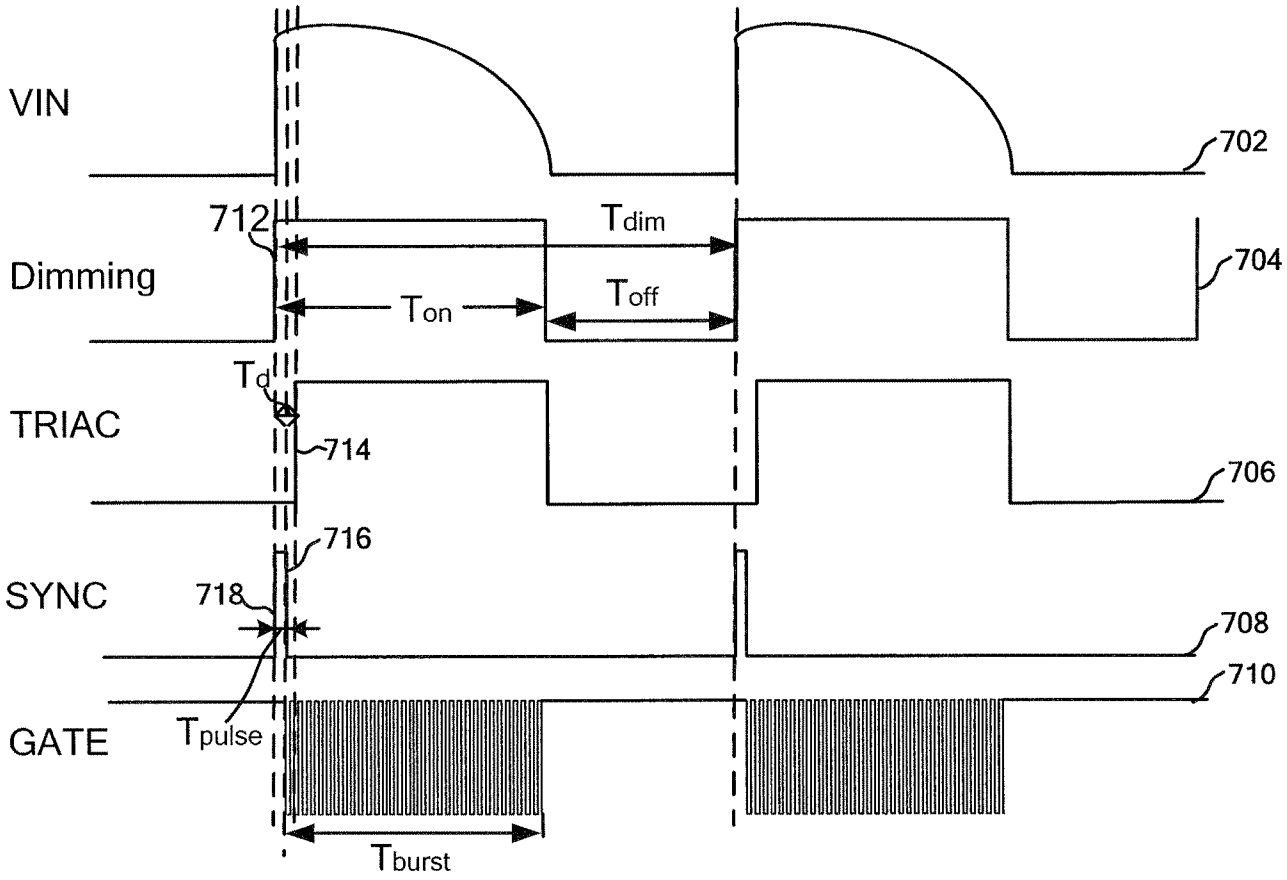
FIG. 7 shows simplified timing diagrams for the system controller as part of the system shown in FIG. 5 according to an embodiment of the present invention.

FIG. 7 shows simplified timing diagrams for the system controller 502 as part of the system 500 according to an embodiment of the present invention. These diagrams are merely examples, which should not unduly limit the scope of the claims. One of ordinary skill in the art would recognize many variations, alternatives, and modifications. The waveform 702 represents the input signal 596 as a function of time, the waveform 704 represents the dimming signal 624 as a function of time, and the waveform 706 represents the control signal 594 as a function of time. In addition, the waveform 708 represents the synchronization signal 626 as a function of time, and the waveform 710 represents the gate-drive signal 592 as a function of time.

Referring back to FIG. 5, the system controller 502 outputs the gate-drive signal 592 to drive the switch 530 in order to regulate the current 588 flowing through the LEDs 598, in some embodiments. For example, when the light dimmer 511 is turned on, the system 500 receives the AC input 510 that is not zero, and the system controller 502 generates the gate-drive signal 592 to drive the switch 530 in order to deliver power to the LEDs 598. In another example, when the light dimmer 511 is turned off, the AC input 510 has a very low magnitude (e.g., zero), and little power would be transferred to the LEDs 598.

Though the light dimmer 511 can adjust a ratio between the time period when the light dimmer 511 is on and the time period when the light dimmer 511 is off, the light dimmer 511 cannot regulate the power delivered to the LEDs 598 during the time period when the light dimmer 511 is on according to certain embodiments. For example, if power delivered to the LEDs 598 is not approximately constant over time, the output current 588 would be fluctuating, which may cause the LEDs 598 to flicker, particularly when the on-time period is relatively short. Hence, the system controller 502 is used to regulate the output power during the time period when the light dimmer 511 is on in some embodiments.

In one embodiment, as shown in FIG. 6, the comparator 602 generates the dimming signal 624 based on the input signal 596 and the threshold signal 622, and the dimming signal 624 is associated with a dimming period. In another example, if the dimming signal 624 is at a logic high level, it indicates that the light dimmer 511 is on. In yet another example, if the dimming signal 624 is at a logic low level, it indicates that the light dimmer 511 is off. Hence, a rising edge of the dimming signal 624 corresponds to a time at which the light dimmer 511 is turned on (e.g., as shown by the waveforms 702 and 704) according to certain embodiments. For example, a dimming period associated with the dimming signal 624 (e.g., $T_{dim}$) corresponds to a period associated with the input signal 596. In another example, the dimming period (e.g., $T_{dim}$) includes an on-time period (e.g., $T_{on}$) and an off-time period (e.g., $T_{off}$) as shown by the waveform 704.

In another embodiment, as shown in FIG. 7, the synchronization component 608 generates a pulse 718 of the synchronization signal 626 in response to a rising edge 712 of the dimming signal 624 as shown by the waveforms 704 and 708. For example, the pulse 718 includes a falling edge 716 and is associated with a pulse width (e.g., $T_{pulse}$). In another example, a rising edge 714 of the control signal 594 appears a delay (e.g., $T_d$) after the rising edge 712 of the dimming signal 624 (e.g., as shown by the waveforms 704 and 706). That is, the switch 504 is closed (e.g., on) a delay (e.g., $T_d$) after the rising edge 712 of the dimming signal 624, as an example. In yet another example, the gate driver 614 begins to change the gate-drive signal 592 between a logic high level and a logic low level for a burst period (e.g., $T_{burst}$) at the falling edge 716 of the pulse 718 (e.g., as shown by the waveform 710). In yet another example, the burst period within each dimming period is approximately the same in duration. The duty cycle and the frequency of the gate-drive signal 592 are kept approximately the same in different dimming periods of the dimming signal 626. That is, the gate-drive signal 592 is synchronized with the dimming signal 624 through the synchronization signal 626, as an example. Thus, during each dimming period, output power is kept approximately the same and the current 588 that flows through the LEDs 598 is kept approximately constant according to certain embodiments.

As shown in FIG. 7, a leading edge of the input signal 596 (e.g., VIN) during an on-time period (e.g., $T_{on}$) is removed because the light dimmer 511 is a leading edge light dimmer according to certain embodiments. For example, when the light dimmer 511 is turned on, a significant voltage change occurs, and correspondingly the peak value of the output current 588 changes significantly. In another example, the switch 530 receives a strike of a large instant current, and such a large instant current (e.g., a sudden change of output load) may distort the waveform of the input signal 596 (e.g., oscillation). A soft control scheme is implemented in some embodiments to reduce the current strike to the switch 530 when the light dimmer 511 is turned on.

Figure 8:
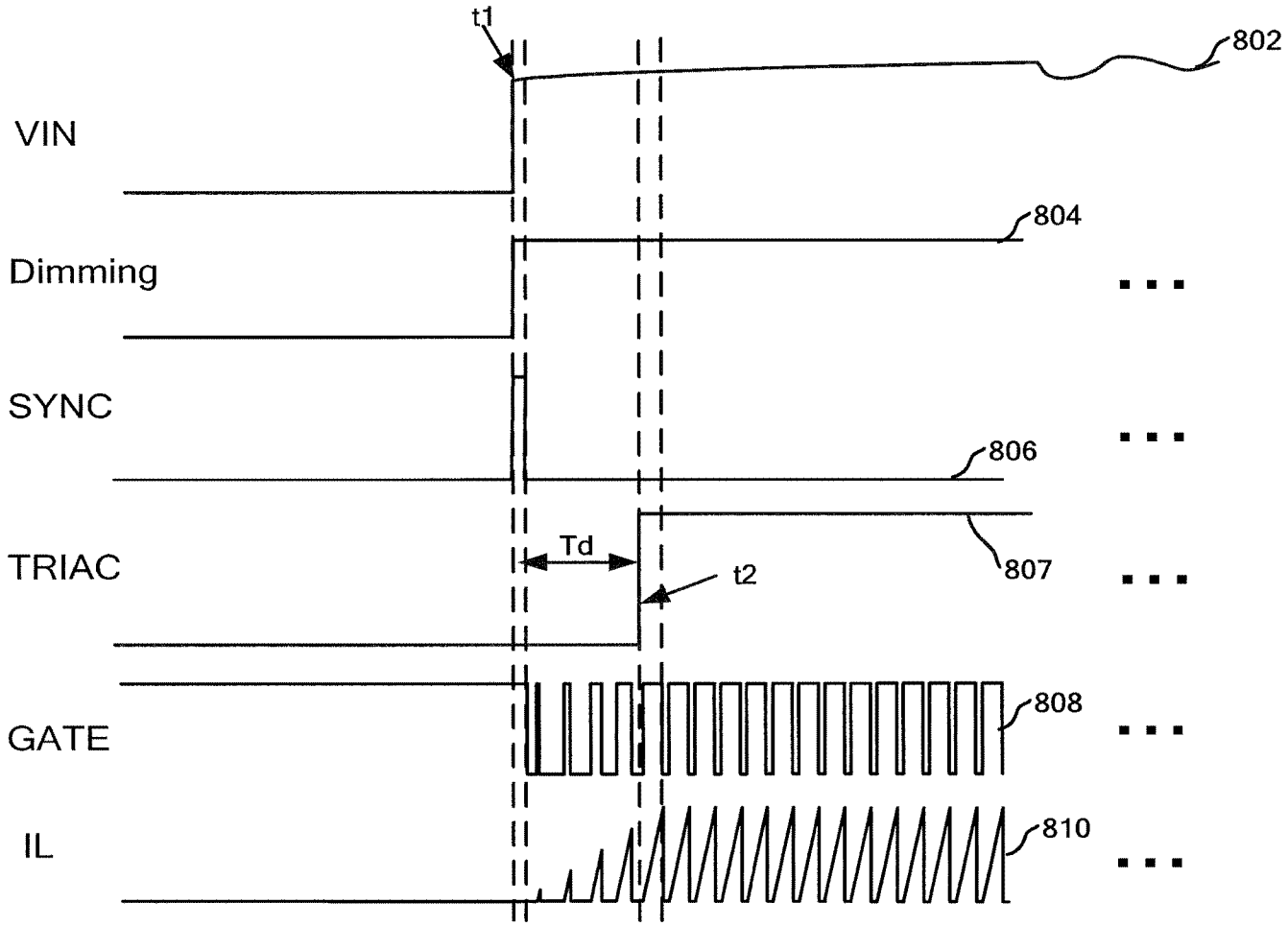
FIG. 8 shows simplified timing diagrams for the system controller as part of the system shown in FIG. 5 according to another embodiment of the present invention.

FIG. 8 shows simplified timing diagrams for the system controller 502 as part of the system 500 according to another embodiment of the present invention. These diagrams are merely examples, which should not unduly limit the scope of the claims. One of ordinary skill in the art would recognize many variations, alternatives, and modifications. The waveform 802 represents the input signal 596 as a function of time, the waveform 804 represents the dimming signal 624 as a function of time, and the waveform 806 represents the synchronization signal 626 as a function of time. In addition, the waveform 807 represents the control signal 594 as a function of time, the waveform 808 represents the gate-drive signal 592 as a function of time, and the waveform 810 represents the current 590 that flows through the switch 530 as a function of time.

As shown in FIG. 8, a rising edge of the dimming signal 624 corresponds to the time at which the light dimmer 511 is turned on (e.g., $t_1$ as shown by the waveforms 802 and 804) according to certain embodiments. For example, the synchronization component 608 generates a pulse in the synchronization signal 626 corresponding to the rising edge of the dimming signal 624 (e.g., as shown by the waveforms 804 and 806). In another example, a rising edge of the control signal 594 appears a delay (e.g., $T_d$) after the rising edge of the dimming signal 624 (e.g., as shown by the waveforms 804 and 807). That is, the switch 504 is closed (e.g., on) at time $t_2$, as an example.

Referring to FIG. 6, the soft control component 606 receives the dimming signal 624 and outputs the signal 628 to the multiplier 610 in some embodiments. For example, the multiplier 610 also receives the input signal 596 and the amplified signal 630 and outputs the signal 632 to the comparator 612 that generates a comparison signal 636. In another example, the gate driver 614 receives the comparison signal 636 and the synchronization signal 626 and outputs the gate-drive signal 592.

In another embodiment, when the light dimmer 511 is turned on, the soft control component 606 changes the signal 628 to affect the gate-drive signal 592 so that the duty cycle of the gate-drive signal 592 is gradually increased over time (e.g., as shown by the waveform 808). For example, peak values of the current 590 that flows through the switch 530 increases gradually (e.g., as shown by the waveform 810). Thus, the instant current strike on the switch 530 when the light dimmer 511 is turned on is reduced according to certain embodiments.

As discussed above, and further emphasized here, FIGS. 5, 6, 7 and 8 are merely examples, which should not unduly limit the scope of the claims. One of ordinary skill in the art would recognize many variations, alternatives, and modifications. For example, a system controller can be implemented in a BUCK structure to achieve similar schemes as shown in FIGS. 5, 6, 7 and 8.

Figure 9:
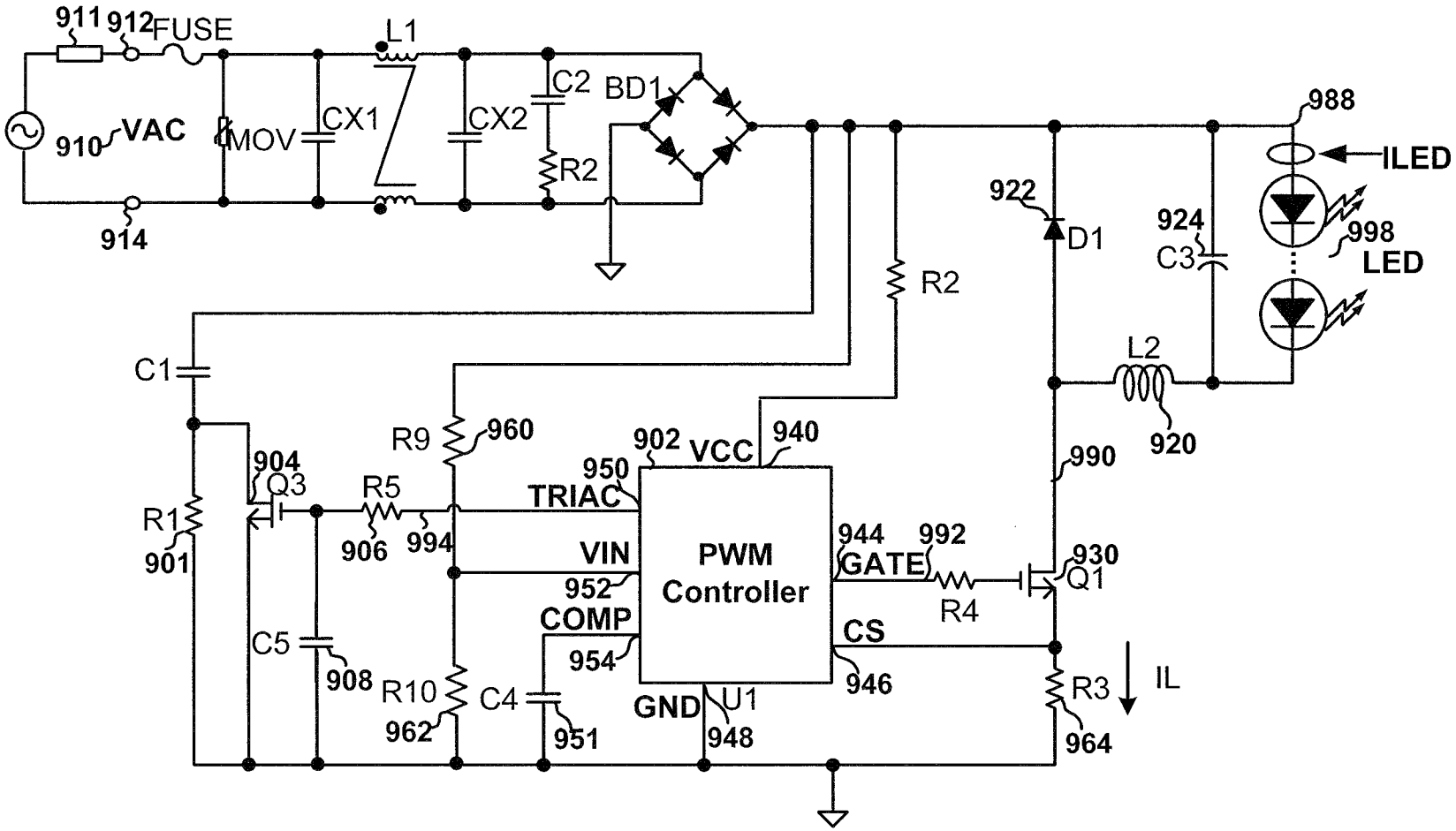
FIG. 9 is a simplified diagram showing a system for dimming control according to another embodiment of the present invention.

FIG. 9 is a simplified diagram showing a system for dimming control according to another embodiment of the present invention. This diagram is merely an example, which should not unduly limit the scope of the claims. One of ordinary skill in the art would recognize many variations, alternatives, and modifications. The system 900 includes a light dimmer 911, input terminals 912 and 914, a system controller 902, resistors 901, 906, 960, 962 and 964, capacitors 908 and 924, switches 904 and 930, an inductor 920, a diode 922, and LEDs 998. For example, the system controller 902 includes terminals 940, 944, 946, 948, 950, 952 and 954. In another example, the system controller 902 is the same as the system controller 502.

According to one embodiment, when the light dimmer 911 (e.g., a TRIAC) is turned on, an AC input 910 (e.g., VAC) is provided to the input terminals 912 and 914. For example, at the terminal 952 (e.g., VIN), the system controller 902 receives an input signal 996 from a voltage divider including the resistors 960 and 962. In another example, in response, the system controller 902 generates one or more control signals (e.g., a signal 994 from the terminal 950) to affect operating status of the switch 904 and the resistor 901. In yet another example, the switch 904 and the resistor 901 are connected in parallel. In yet another example, in response to the signal 994 from the terminal 950 (e.g., terminal TRIAC), the switch 904 is open (e.g., off), allowing the resistor 901 to dampen initial current surge to one or more capacitive loads. In yet another example, after the light dimmer 911 conducts for a predetermined period of time, the switch 904 is closed (e.g., on) in response to the signal 994 from the terminal 950 (e.g., terminal TRIAC), thus shorting the resistor 901 in order to improve the system efficiency. In yet another example, the system controller 902 outputs a gate-drive signal 992 to the switch 930. In yet another example, in response, the switch 930 is turned on or off in order to regulate a current 988 that flows through the LEDs 998.

Figure 10:
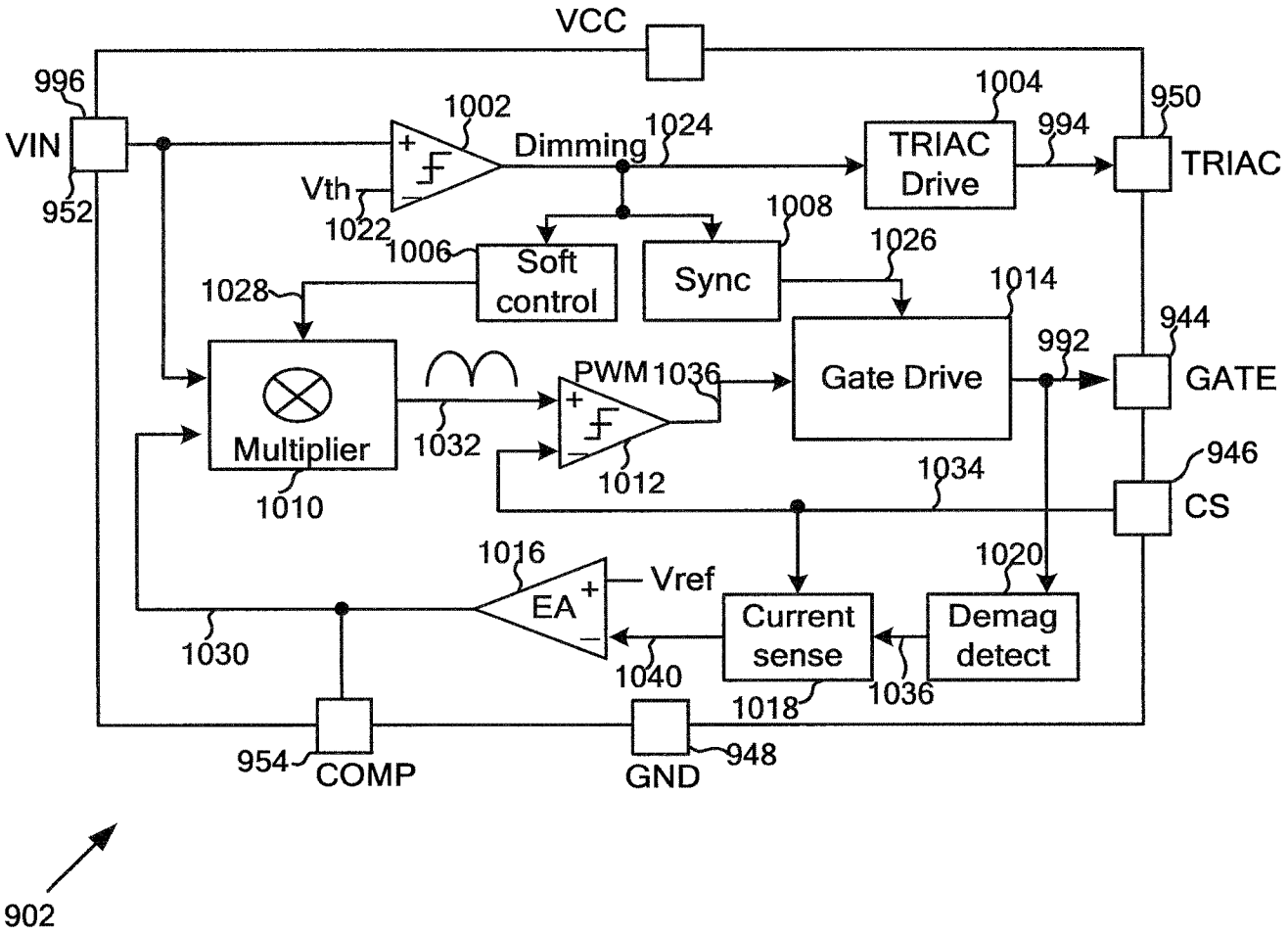
FIG. 10 is a simplified diagram of the system controller as part of the system shown in FIG. 9 according to an embodiment of the present invention.

FIG. 10 is a simplified diagram of the system controller 902 as part of the system 900 according to an embodiment of the present invention. This diagram is merely an example, which should not unduly limit the scope of the claims. One of ordinary skill in the art would recognize many variations, alternatives, and modifications. The system controller 902 includes comparators 1002 and 1012, a signal generator 1004, a soft control component 1006, a synchronization component 1008, a multiplier 1010, a gate driver 1014, an error amplifier 1016, a current sensing component 1018, and a demagnetization detector 1020.

In one embodiment, the system controller 902 receives the input signal 996 in order to detect the change of the AC input 910. For example, the comparator 1002 receives the input signal 996 and a threshold signal 1022, and generates a dimming signal 1024. In another example, the signal generator 1004 receives the dimming signal 1024 and generates the control signal 994 to drive the switch 904. In yet another example, the synchronization component 1008 also receives the dimming signal 1024 and outputs a synchronization signal 1026 to the gate driver 1014 which generates the gate-drive signal 992 to drive the switch 930. In yet another example, the soft control component 1006 receives the dimming signal 1024 and outputs a signal 1028 to the multiplier 1010.

In another embodiment, the multiplier 1010 also receives the input signal 996 and an amplified signal 1030 from the error amplifier 1016, and outputs a signal 1032. For example, the comparator 1012 receives the signal 1032 and a current sensing signal 1034 that indicates the current 990 flowing through the switch 930, and outputs a comparison signal 1036 to the gate driver 1014 in order to affect the status of the switch 930.

In yet another embodiment, the demagnetization component 1020 receives the gate-drive signal 992 and detects when a demagnetization process of the inductor 920 ends using a parasitic capacitance associated with the switch 930. For example, the demagnetization component 1020 outputs a demagnetization signal 1036 to the current sensing component 1018 in order to affect the sampling and/or holding of the current sensing signal 1034. For example, the error amplifier 1016 receives a signal 1040 from the current sensing component 1018, and an output terminal of the error amplifier 1016 is connected to the capacitor 951 through the terminal 954 (e.g., COMP) to keep the system 900 stable.

As discussed above, and further emphasized here, FIG. 9 is merely an example, which should not unduly limit the scope of the claims. One of ordinary skill in the art would recognize many variations, alternatives, and modifications. For example, peripheral circuits, instead of the parasitic capacitance associated with the switch 930, can be used for detecting when the demagnetization process of the inductor 920 ends as shown in FIG. 11.

Figure 11:
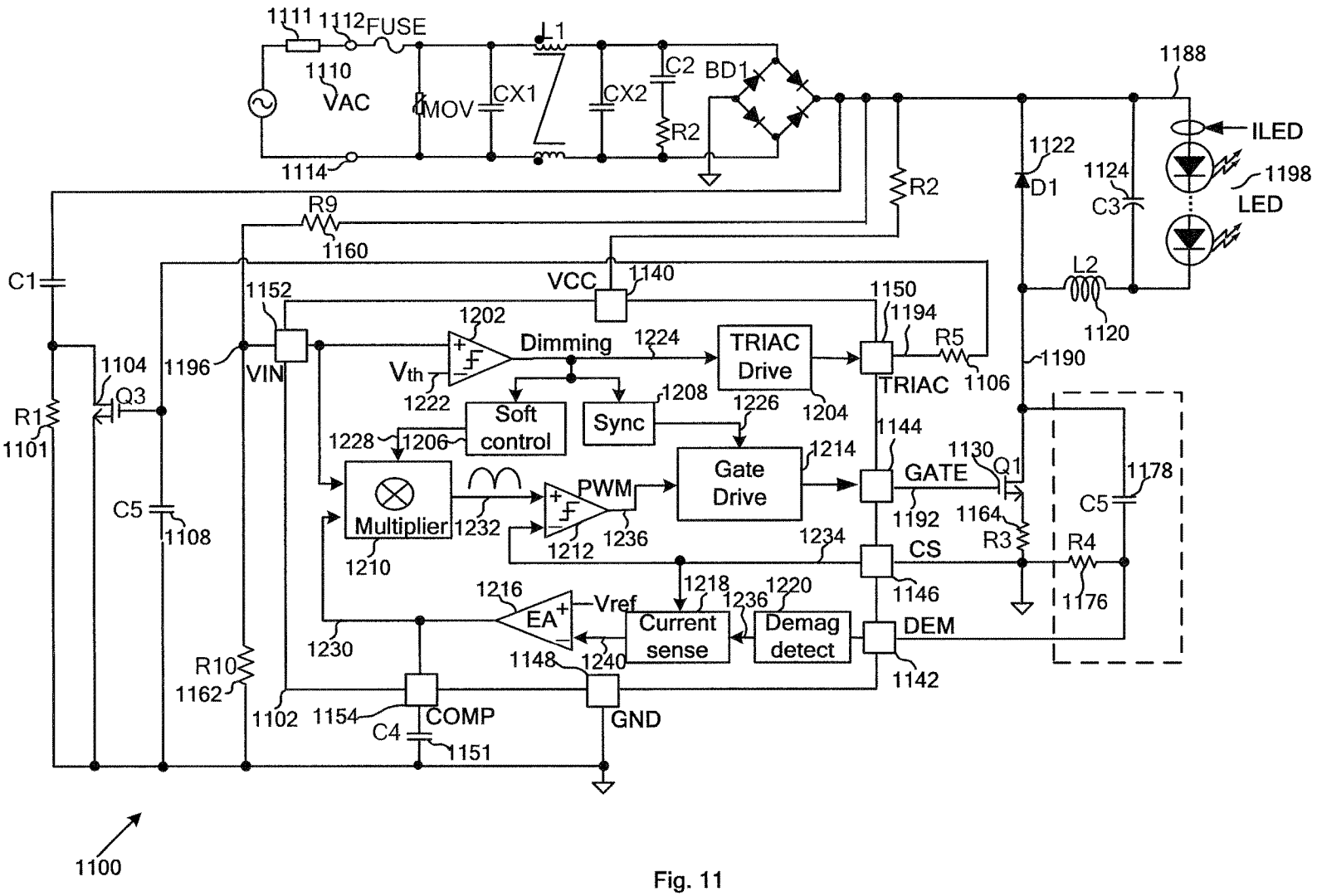
FIG. 11 is a simplified diagram showing a system for dimming control according to yet another embodiment of the present invention.

FIG. 11 is a simplified diagram showing a system for dimming control according to yet another embodiment of the present invention. This diagram is merely an example, which should not unduly limit the scope of the claims. One of ordinary skill in the art would recognize many variations, alternatives, and modifications. The system 1100 includes a light dimmer 1111, input terminals 1112 and 1114, a system controller 1102, resistors 1101, 1106, 1160, 1162, 1164 and 1176, capacitors 1108, 1124 and 1178, switches 1104 and 1130, an inductor 1120, a diode 1122, and LEDs 1198. The system controller 1102 includes comparators 1202 and 1212, a signal generator 1204, a soft control component 1206, a synchronization component 1208, a multiplier 1210, a gate driver 1214, an error amplifier 1216, a current sensing component 1218, and a demagnetization detector 1220. In addition, the system controller 1102 includes terminals 1140, 1142, 1144, 1146, 1148, 1150, 1152 and 1154. For example, the system controller 1102 is the same as the system controller 502.

According to one embodiment, when the light dimmer 1111 (e.g., a TRIAC) is turned on, an AC input 1110 (e.g., VAC) is provided to the input terminals 1112 and 1114. For example, at the terminal 1152 (e.g., VIN), the system controller 1102 receives an input signal 1196 from a voltage divider including the resistors 1160 and 1162. In another example, in response, the system controller 1102 generates one or more control signals (e.g., a signal 1194 from the terminal 1150) to affect operating status of the switch 1104 and the resistor 1101. In yet another example, the switch 1104 and the resistor 1101 are connected in parallel. In yet another example, in response to the signal 1194 from the terminal 1150 (e.g., terminal TRIAC), the switch 1104 is open (e.g., off), allowing the resistor 1101 to dampen initial current surge to one or more capacitive loads. In yet another example, after the light dimmer conducts for a predetermined period of time, the switch 1104 is closed (e.g., on) in response to the signal 1194 from the terminal 1150 (e.g., terminal TRIAC), thus shorting the resistor 1101 in order to improve the system efficiency. In yet another example, the system controller 1102 outputs a gate-drive signal 1192 to drive the switch 1130. In yet another example, in response, the switch 1130 is turned on or off in order to regulate a current 1188 that flows through the LEDs 1198.

According to another embodiment, the system controller 1102 receives the input signal 1196 at the terminal 1152 (e.g., terminal VIN). For example, the comparator 1202 receives the input signal 1196 and a threshold signal 1222, and generates a dimming signal 1224. In another example, the signal generator 1204 receives the dimming signal 1224 and generates the control signal 1194 to drive the switch 1104. In yet another example, the synchronization component 1208 also receives the dimming signal 1224 and outputs a synchronization signal 1226 to the gate driver 1214 which generates the gate-drive signal 1192 to drive the switch 1130. In yet another example, the soft control component 1206 receives the dimming signal 1224 and generates a signal 1228 to the multiplier 1210.

According to yet another embodiment, the multiplier 1210 also receives the input signal 1196 and an amplified signal 1230 from the error amplifier 1216, and outputs a signal 1232. For example, the comparator 1212 receives the signal 1232 and a current sensing signal 1234 that indicates the current 1190 flowing through the primary winding 1122, and outputs a comparison signal 1236 to the gate driver 1214 in order to affect the status of the switch 1130.

A demagnetization detection circuit including the resistor 1176 and the capacitor 1178 is used for detecting when the demagnetization process of the inductor 1120 ends, instead of using a parasitic capacitance associated with the switch 1130 in some embodiments. For example, when the demagnetization process of the inductor 1120 ends, the voltage change of the inductor 1120 is coupled to the terminal 1142 (e.g., terminal DEM) through at least the capacitor 1178. In another example, the demagnetization component 1220 detects the voltage change of the inductor 1120 and outputs a demagnetization signal 1236 to the current sensing component 1218 in order to affect the sampling and/or holding of a current sensing signal 1234 which indicates a current 1190 flowing through the switch 1130. In yet another example, the error amplifier 1216 receives a signal 1240 from the current sensing component 1218, and an output terminal of the error amplifier 1216 is connected to the capacitor 1151 through the terminal 1154 (e.g., COMP) to keep the system 1100 stable.

In some embodiments, the schemes shown in FIG. 7 and/or FIG. 8 apply to the system controller 902 as part of the system 900 and/or the system controller 1102 as part of the system 1100. For example, the system controller 902 as part of the system 900 has similar timing diagrams as shown in FIG. 7 and/or FIG. 8. In another example, the system controller 1102 as part of the system 1100 has similar timing diagrams as shown in FIG. 7 and/or FIG. 8.

According to another embodiment, a system for dimming control includes a system controller, a transistor, and a first resistor. The system controller includes a first controller terminal and a second controller terminal. The transistor includes a first transistor terminal, a second transistor terminal and a third transistor terminal. The first resistor includes a first resistor terminal and a second resistor terminal. The first transistor terminal is coupled, directly or indirectly, to the second controller terminal. The first resistor terminal is coupled to the second transistor terminal. The second resistor terminal is coupled to the third transistor terminal. The system controller is configured to receive an input signal at the first controller terminal and to generate an output signal at the second controller terminal based on at least information associated with the input signal. The transistor is configured to receive the output signal at the first transistor terminal and to change between a first condition and a second condition based on at least information associated with the output signal. The system controller is further configured to, if the input signal becomes higher than a threshold, change the output signal after a delay in order to change the transistor from the first condition to the second condition. For example, the system is implemented according to at least FIG. 5, FIG. 9 and/or FIG. 11.

According to another embodiment, a system controller for dimming control includes a first controller terminal, and a second controller terminal. The system controller is configured to receive an input signal at the first controller terminal and generate a dimming signal based on at least information associated with the input signal, generate a synchronization signal based on at least information associated with the dimming signal, and output a gate drive signal at the second controller terminal based on at least information associated with the synchronization signal. The system controller is further configured to generate a first pulse of the synchronization signal in response to a first rising edge of the dimming signal, the first pulse including a first falling edge and being associated with a first pulse width, and start changing the gate drive signal between a first logic level and a second logic level for a first burst period at the first falling edge of the pulse. For example, the system controller is implemented according to FIG. 5, FIG. 6, FIG. 7, FIG. 8, FIG. 9, FIG. 10 and/or FIG. 11.

According to yet another embodiment, a system controller for dimming control includes a first controller terminal and a second controller terminal. The system controller is configured to receive an input signal at the first controller terminal and generate a dimming signal based on at least information associated with the input signal, the dimming signal being associated with a dimming period, and output a gate drive signal at the second controller terminal based on at least information associated with the dimming signal, the gate drive signal being related to a plurality of switching periods included within the dimming period. The plurality of switching periods include a plurality of on-time periods respectively. The system controller is further configured to increase the plurality of on-time periods in duration over time. For example, the system controller is implemented according to FIG. 5, FIG. 6, FIG. 7, FIG. 8, FIG. 9, FIG. 10 and/or FIG. 11.

In another embodiment, a method for dimming control using at least a system controller including a first controller terminal and a second controller terminal includes receiving an input signal at the first controller terminal, processing information associated with the input signal, and generating an output signal at the second controller terminal based on at least information associated with the input signal in order to change a transistor between a first condition and a second condition, the transistor including a first transistor terminal, a second transistor terminal and a third transistor terminal, the first transistor terminal being coupled, directly or indirectly, to the second controller terminal. In addition, the method includes, if the input signal becomes higher than a threshold, changing the output signal after a delay in order to change the transistor from the first condition to the second condition, and shorting a resistor by the transistor in the second condition, the resistor including a first resistor terminal and a second resistor terminal, the first resistor terminal being coupled to the second transistor terminal, the second resistor terminal being coupled to the third transistor terminal. For example, the method is implemented according to at least FIG. 5, FIG. 9 and/or FIG. 11.

In yet another embodiment, a method for dimming control using at least a system controller including a first controller terminal and a second controller terminal includes receiving an input signal at the first controller terminal, processing information associated with the input signal, and generating a dimming signal based on at least information associated with the input signal. Further, the method includes processing information associated with the dimming signal, generating a synchronization signal based on at least information associated with the dimming signal, processing information associated with the synchronization signal, and outputting a gate drive signal at the second controller terminal based on at least information associated with the synchronization signal. The process for generating a synchronization signal based on at least information associated with the dimming signal includes generating a first pulse of the synchronization signal in response to a first rising edge of the dimming signal, the first pulse including a first falling edge and being associated with a first pulse width. The process for outputting a gate drive signal at the second controller terminal based on at least information associated with the synchronization signal includes starting changing the gate drive signal between a first logic level and a second logic level for a first burst period at the first falling edge of the pulse. For example, the method is implemented according to FIG. 5, FIG. 6, FIG. 7, FIG. 8, FIG. 9, FIG. 10 and/or FIG. 11.

In yet another embodiment, a method for dimming control using at least a system controller including a first controller terminal and a second controller terminal includes receiving an input signal at the first controller terminal, processing information associated with the input signal, and generating a dimming signal based on at least information associated with the input signal, the dimming signal being associated with a dimming period. In addition, the method includes processing information associated with the dimming signal, and outputting a gate drive signal at the second controller terminal based on at least information associated with the dimming signal, the gate drive signal being related to a plurality of switching periods included within the dimming period. The plurality of switching periods include a plurality of on-time periods respectively. The plurality of on-time periods increase in duration over time. For example, the method is implemented according to FIG. 5, FIG. 6, FIG. 7, FIG. 8, FIG. 9, FIG. 10 and/or FIG. 11.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system for dimming control, the system comprising:
a system controller;
wherein the system controller includes:
a first controller terminal; and
a second controller terminal;
wherein:
a second transistor terminal of a transistor is coupled to a first resistor terminal of a first resistor, the transistor further including a first transistor terminal and a third transistor terminal, the first resistor further including a second resistor terminal; and
the second resistor terminal is coupled to the third transistor terminal;
wherein:
the system controller is configured to receive an input signal at the first controller terminal and to generate an output signal at the second controller terminal based at least in part on the input signal; and
the system controller is further configured to, in response to the input signal becoming larger in magnitude than a threshold signal, change the output signal after a delay in order to change the transistor from a first condition to a second condition;
wherein the transistor is configured to receive the output signal at the first transistor terminal and to change between the first condition and the second condition based at least in part on the output signal.

2. The system of claim 1 wherein the transistor is configured to be turned off under the first condition and be turned on under the second condition.

3. The system of claim 1, and further comprising:
a second resistor including a third resistor terminal and a fourth resistor terminal;
wherein:
the first transistor terminal is coupled to the third resistor terminal; and
the second controller terminal is coupled to the fourth resistor terminal.

4. The system of claim 3 wherein the first transistor terminal is coupled indirectly to the third resistor terminal.

5. The system of claim 3 wherein the second controller terminal is coupled indirectly to the fourth resistor terminal.

6. The system of claim 1 wherein the input signal is generated by a voltage divider.

7. The system of claim 6 wherein the voltage divider includes a third resistor and a fourth resistor.

8. The system of claim 1 wherein the third transistor terminal is biased at a first voltage.

9. The system of claim 1 wherein the second controller terminal is coupled indirectly to the first transistor terminal.

10. The system of claim 1 wherein the second transistor terminal is coupled indirectly to the first resistor terminal.

11. The system of claim 1 wherein the second resistor terminal is coupled indirectly to the third transistor terminal.

12. A method for dimming control, the method comprising:
receiving an input signal;
processing the input signal;
generating an output signal based at least in part on the input signal in order to change a transistor between a first condition and a second condition, the transistor including a first transistor terminal, a second transistor terminal and a third transistor terminal; and
in response to the input signal becoming larger in magnitude than a threshold signal, changing the output signal after a delay in order to change the transistor from the first condition to the second condition and to short a resistor by the transistor in the second condition, the resistor including a first resistor terminal and a second resistor terminal, the second transistor terminal being coupled to the first resistor terminal, the second resistor terminal being coupled to the third transistor terminal.

13. The method of claim 12, and further comprising:
turning off the transistor under the first condition; and
turning on the transistor under the second condition.

14. The method of claim 12, and further comprising: generating the input signal by a voltage divider.

15. The method of claim 12 wherein the third transistor terminal is biased at a first voltage.

16. The method of claim 12 wherein the second transistor terminal is coupled indirectly to the first resistor terminal.

17. The method of claim 12 wherein the second resistor terminal is coupled indirectly to the third transistor terminal.

* * * * *